United States Patent [19]

Poe

[11] Patent Number: 4,901,765

[45] Date of Patent: Feb. 20, 1990

[54] COUPLING FOR MIXING LOTIONS OR OTHER LIQUIDS WITH SHOWER WATER

[76] Inventor: Frank C. Poe, 300 Second St., Maryville, Tenn. 37801

[21] Appl. No.: 264,861

[22] Filed: Oct. 31, 1988

[51] Int. Cl.[4] ..... B01F 5/04

[52] U.S. Cl. ..... 137/893; 239/318

[58] Field of Search ..... 137/892, 893, 216; 239/318

[56] References Cited

U.S. PATENT DOCUMENTS

| | | | |
|---|---|---|---|
| 2,690,717 | 10/1954 | Goodrie . | |
| 3,072,137 | 1/1963 | McDougall | 137/893 X |
| 3,333,601 | 8/1967 | Lofgreen . | |
| 4,121,773 | 10/1978 | Headen . | |
| 4,218,013 | 8/1980 | Davison . | |
| 4,358,056 | 11/1982 | Greenhut | 239/318 X |
| 4,607,793 | 8/1986 | Eberle . | |
| 4,651,930 | 3/1987 | Magaha . | |
| 4,697,610 | 10/1987 | Bricker | 239/318 X |

FOREIGN PATENT DOCUMENTS

| | | | |
|---|---|---|---|
| 431706 | 7/1935 | United Kingdom | 239/318 |

*Primary Examiner*—Robert G. Nilson

*Attorney, Agent, or Firm*—Pitts and Brittian

[57] ABSTRACT

A coupling (10) for being mounted between the threaded end of the arm (16) of a shower through which water flows and the showerhead (18) for mixing liquid into shower water. The coupling (10) includes a coupling body (20) having an inlet portion and an outlet portion with a flow path defined therebetween. A mixing chamber (32) is mounted in fluid communication with the flow path through the coupling body (20) which serves to selectively mix liquid such as body lotion with the water. In this regard, a vacuum generated by a venturi serves to draw the liquid into the mixing chamber. The vacuum is selectively controlled by a vacuum actuator (52) which holds the vacuum until the shower is turned off.

2 Claims, 1 Drawing Sheet

COUPLING FOR MIXING LOTIONS OR OTHER LIQUIDS WITH SHOWER WATER

TECHNICAL FIELD

This invention relates generally to a coupling for being interposed between the shower arm and showerhead, and more particularly concerns such a coupling which is designed for mixing body lotion or other liquids with shower water. The device is designed in the preferred embodiment to have an automatic shut-off feature.

BACKGROUND ART

It will be appreciated by those skilled in the art, that devices have heretofore been known for mixing liquids with water. Such devices typically provide a dispensing apparatus or assembly which is attached into the flow path of water discharged from a showerhead or faucet. Certain devices also include dispensing reservoirs of particular designs which are compatible with the dispenser itself to mix the liquid with the water. As an example, U.S. Pat. No. 4,358,056 discloses a shower dispenser which includes a reservoir assembly for holding a liquid and a mixer coupling for connecting a shower water supply and liquid contained within the reservoir. The reservoir assembly includes a specially designed housing having a first and second reservoir or containers which can hold liquid to be mixed into the water. Moreover, this device includes a check valve ball which is designed to move against a valve seat to prevent backward flow of liquid which might otherwise be occasioned by the flow of pressurized water into the venturi. Other known prior art devices are disclosed in the following U.S. Pat. Nos.: 2,690,717; 3,333,601; 4,121,773; 4,218,013; 4,607,703; 4,651,930; and 4,697,610.

While known prior art devices have addressed the problem of providing a device for mixing liquid into shower water, certain disadvantages remain.

Accordingly, it is an object of the present invention to provide an inexpensive coupling which will mix liquid with the shower water and which has a minimal number of moving parts which can wear out.

Another object of the present invention is to provide such a coupling which prevents backward flow of water into the liquid dispensing reservoir without the need of an additional check valve.

Yet another object of the present invention is to provide such a coupling for mixing liquids with the shower water which can be readily installed and which incorporates in the preferred embodiment an automatic shut-off feature which vents the venturi vacuum to atmosphere when the flow of water through showerhead is terminated.

Also, it is an object of the present invention to provide such a coupling for mixing liquid and shower water which can be readily actuated by the simple depression of a vacuum actuator button.

DISCLOSURE OF THE INVENTION

Other objects and advantages will be obvious and will in part appear hereinafter, and will be accomplished by the present invention which provides a coupling for mixing liquid contained in a remote reservoir with the shower water. The coupling includes a body which defines an inlet portion for threadably receiving a shower arm and an outlet portion which is threadably connected to the showerhead. A first flow path from the inlet to the outlet is defined in the shower body portions to allow water to flow therethrough. A fitting, integrally formed with the shower body, receives liquid from the reservoir. This fitting defines a further flow path terminating in an orifice which is in fluid communication with the first flow path. A venturi device serves to generate a vacuum at a location proximate the further flow path for drawing liquid into the coupling. A vacuum control mechanism serves to commence and vent the vacuum generated by the venturi means. This vacuum control means in the preferred embodiment can be actuated to draw liquid by simple depressing a vacuum actuator button. The vacuum is automatically terminated upon termination of the flow through the showerhead.

BRIEF DESCRIPTION OF THE DRAWINGS

The above-mentioned features of the present invention will be more clearly understood from the consideration of the following description in connection with the accompanying drawings in which.

BEST MODE FOR CARRYING OUT THE INVENTION

Figure 2:
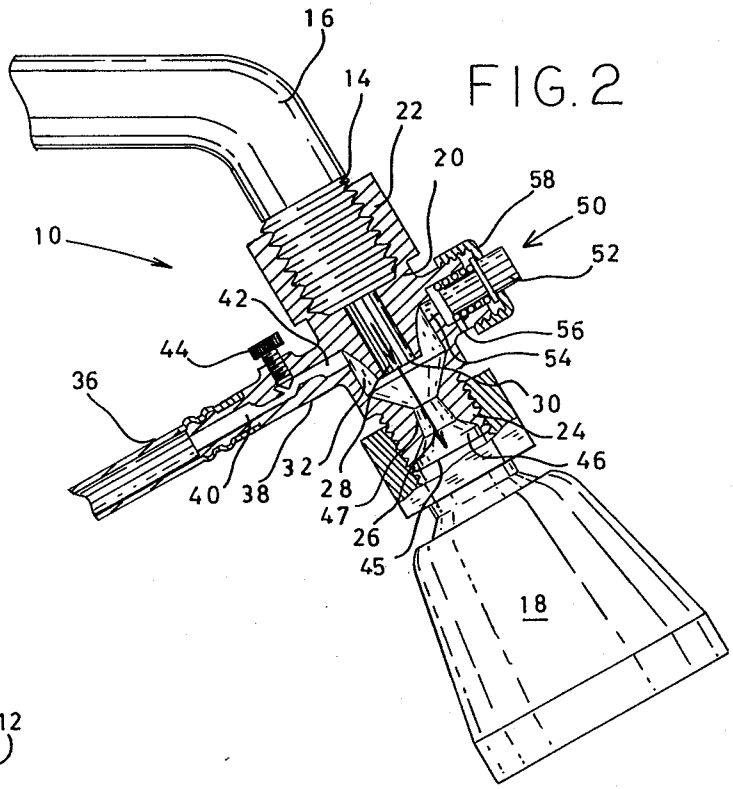
FIG. 2 illustrates a cross-sectional view of the coupling shown in FIG. 1 mounted on a conventional shower arm and between the shower arm and showerhead.

Referring now to the figures, a coupling constructed in accordance with various features of the present invention is generally indicated at 10. This coupling is designed for mixing liquid contained in a remote reservoir 12 with shower water. In this connection, the coupling 10 is mounted between the end 14 of the shower arm 16 through which water flows into the showerhead 18 of conventional design. In this connection, the coupling 10 includes a coupling body 20 which defines an inlet portion 22 and an outlet portion 24. It will be noted in FIG. 2 that the inlet portion 22 of the coupling 20 is internally threaded for threadably receiving the end 14 of the shower arm 16. Also, the outlet portion 20 is threadably connected to the showerhead 18 as shown.

The coupling body 20 defines a first flow path indicated generally by the arrow 26 which extends from the inlet to the outlet portions of the body 20 to allow water to flow therethrough. This flow path 26 includes a first section terminating proximate the location of the arrow head 28 in an orifice 30. This first section of the flow path 26 is of a reduced dimension (it has a lesser cross-sectional area) than the other sections of the first flow path that will be described hereinafter, in the preferred embodiment. Orifice 30 of the first section of the flow path 26 is disposed in fluid communication with a mixing chamber indicated at 32. This mixing chamber, it will be noted, has a cross-sectional outline, or is dimensioned, such that it is larger than the cross-sectional outline of the first section of the flow path 26. Moreover, the configuration of the mixing chamber and the orifice 30 of the first section of the flow path 26 defines a venturi which generates a vacuum. The vacuum generated proximate the mixing chamber 32 serves to draw liquid from the reservoir 12, or reservoir 12' at an optional location, which is connected through conduit 36 to the flow path 26. In this regard, a fitting 38 is provided. This fitting 38 is integrally formed with the body 20 of the coupling 10 and defines a further flow path 40 which terminates in a further orifice 42 positioned in fluid communication with the mixing chamber 32. Thus, the vacuum generated by the venturi effect draws liquid through the conduit 36 along further flow path 40 into the mixing chamber 32 where it is mixed with water travelling along the first section 28 of the flow path 26.

The rate at which liquid is drawn through the further flow path 42 is partially controlled through the vacuum regulator 44. This regulator, as illustrated, incorporates a thumb type screw which can be selectively adjusted for opening and closing the further flow path 40 through the fitting 38.

The mixture of liquid drawn from the reservoir 12 and water flowing through the mixing chamber exits the mixing chamber into the further section 46 of the first flow path 26. The shower water and liquid passing through further section 46 exits the coupling 10 through the downstream end of the further section 46 into the showerhead 18 where it is dispensed. It will be noted that the further section 46 of the flow path 26 includes a restricted and flared bore 47 positioned between the mixing chamber 32 and the downstream end 45. This flared bore has walls which flare outwardly in a downstream direction (in the direction of the arrow for flow path 26), and which serve to enhance the vacuum generated by the venturi means. Thus, the restricted bore 47 comprises part of the venturi means in the preferred embodiment.

It will be noted from FIG. 2 that the coupling 10 includes a mixing chamber 32 wherein liquid drawn from the further flow path 40 defined in the fitting 38 is mixed with water exiting the first section 28 of the flow path 26. The further section 46 of the flow path 26 is positioned downstream from the mixing chamber and is dimensioned less than the chamber as shown, but greater than the dimension of the first section terminating in arrow head 28 to enhance the mixing of the liquid and water. Moreover, it will be noted that the dimension of the first section terminating at the location of arrow head 28 of the first flow path 26 is of a lesser dimension that the flow path through the end 14 of the arm 16 to enhance the pressure of water passing through the coupling 10.

A vacuum control means is generally indicated at 50 and serves to commence and vent the vacuum generated by the venturi action produced within the mixing chamber 32. This vacuum control means 50 includes a vacuum actuator 52 which comprises a button in the illustrated embodiment that serves to control the flow of air through third flow path 54 which is defined in the fitting 56. It will be noted that the fitting 56 is integrally formed with the body 20 of the coupling 10. The vacuum actuator 52 is held in position by the internally threaded member 58, that is threadably received on the externally threaded fitting 56 shown in FIG. 2. When the actuator button 52 is depressed, its distal end portion rests against the valve seat defined proximate the location of the portion of the third flow path 54 of diminished dimension, thereby closing off the flow of air through the third flow path 54. When this happens, the vacuum normally generated by the venturi effect within the mixing chamber 32 draws liquid through the further flow path 40 where upon it is mixed with shower water and discharged through the showerhead.

When the shower water is turned off, the vacuum actuator 52 is biased outwardly by the illustrated spring such that the third flow path 54 can be vented in and around the vacuum actuator button 52 through the opening in the member 58 which receives the head of the actuator button. Thus, when the shower is turned on again, liquid will not be drawn from the reservoir until the actuator button is depressed at which time a vacuum is created for drawing fluid through said further flow path to mix liquid with the shower water.

It will also be noted tat when the vacuum actuator button 52 is depressed, its distal end portion rests against the valve seat closing off the flow of air through the third flow path 54. The spring (shown in FIG. 2) biases the vacuum actuator to its open position, and is designed such that the vacuum created within the mixing chamber 32 is of sufficient strength to hold the vacuum actuator in a closed position where it will remain until the shower water is cut off and it no longer flows through the arm 16. At that point, the spring will bias the vacuum actuator 52 to its open position again allowing venting of the mixing chamber when the shower water is again turned on.

Figure 3:
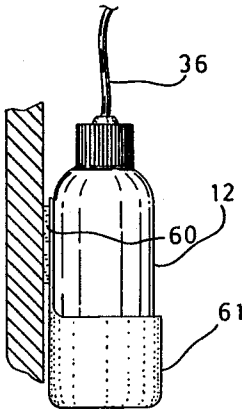
FIG. 3 illustrates a partially cross-sectional view showing a suitable method for mounting the liquid dispensing reservoir on the wall of a shower.
Figure 1:
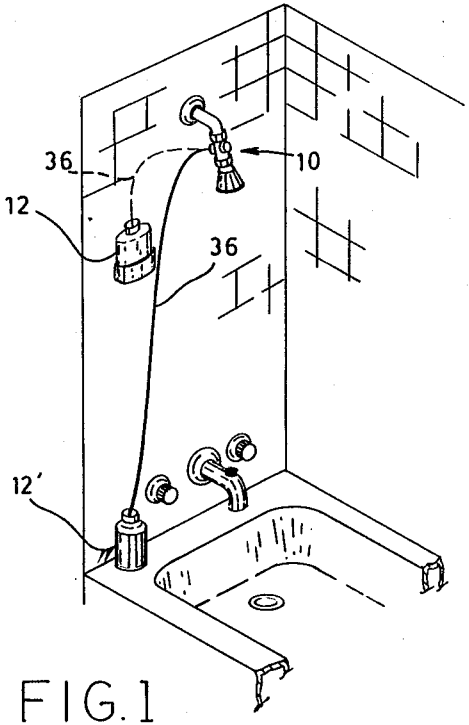
FIG. 1 illustrates a coupling for mixing lotion or other liquids with shower water constructed in accordance with various features of the present invention. Optional mounting locations for the liquid dispensing reservoir are illustrated in a typical shower and tub combination.

FIG. 1 shows alternate locations for mounting the reservoir. For example, reservoir 12' is mounted on the bathtub wall. The reservoir 12 can be secured to the wall of the shower or releasably mounted in support bracket 61 (as is shown in FIG. 3) which is secured to the wall of the shower by a suitable double-back tape generally indicated at 60. In this manner, the location of the reservoir can be selected. Moreover, it will be recognized that the reservoir can be mounted in the soap dish which is common with certain shower stalls.

From the foregoing detailed description, it will be recognized by those skilled in the art that an improved coupling for mixing liquid contained in a remote reservoir with shower water has been provided. The liquid dispensed by the present invention is preferably a body lotion which is administered at the end of the shower. In this regard, a vacuum control means is provided with a vacuum actuator button that is depressed after the shower is complete. This actuator button causes a vacuum generated by venturi action to attempt to vent through the reservoir 12 thereby drawing liquid into a mixing chamber where it is mixed with shower water and dispensed through the showerhead. When the shower water is turned off after the lotion application, the vacuum actuator button returns to its open position allowing venting of the venturi generated vacuum when the next shower is commenced.

Thus, although there has been described to this point particular embodiments of the present invention of a coupling for mixing liquid, and preferably body lotion, with shower water, it is not intended that such specific references be considered as limitations upon the scope of this invention except insofar as set forth in the following claims and equivalents thereof.

I claim:

1. A coupling for being mounted between the threaded end of the arm of a shower through which water flows, and the showerhead for mixing liquid contained in a remote reservoir into shower water, said coupling comprising:

a coupling body defining an inlet portion for threadably receiving said end of said shower arm, and an outlet portion for being threadably connected to said head, said coupling body being provided with a first flow path extending from said inlet to said outlet portions to allow water and mixed liquids to flow therethrough, said first flow path defining a first section of reduced dimension terminating in a first orifice, a mixing chamber wherein said liquid is mixed with water exiting said first section of said first flow path, and a further section downstream from said mixing chamber, said further section being dimensioned less than said chamber and greater at its downstream end than said first section to enhance the mixing of said liquid and said water, said further section including a restricted flared bore between said mixing chamber and said downstream end of said further section;

a fitting integrally formed with said body for receiving said liquid, said fitting defining a further flow path terminating in a second orifice which is in fluid communication with said mixing chamber at a point upstream from said first orifice of said first section of said first flow path; whereby venturi means are defined by said body for generating a vacuum at a location proximate said second orifice of said further flow path for drawing said liquid into said mixing chamber, and whereby said further section enhances the vacuum generated by said venturi means; and vacuum control means for commencing and venting the vacuum generated by said venturi means for mixing and terminating the mixing of liquid with said shower water, said vacuum control means including a further fitting integrally formed with said coupling body and defining a third flow path therethrough terminating in a third orifice which is positioned in fluid communication with said mixing chamber, said third orifice being upstream from said first orifice, said vacuum control means further including a vacuum activator button for controlling the flow of air through said third flow path, said flow path being vented proximate and around said button until said button is depressed at which time a vacuum is created for drawing fluid from said further flow path to mix liquid with said shower said vacuum activator button being biased towards an open position which allows venting of said vacuum in and around button through said third flow path and wherein said vacuum activator button remains closed under biasing forces of said vacuum.

2. The vacuum control means of claim 1 which automatically returns to an open position for venting vacuum created by said venturi means when the flow of water through said shower arm and coupling is terminated.

* * * * *